US009157699B2

(12) United States Patent
Ward et al.

(10) Patent No.: US 9,157,699 B2
(45) Date of Patent: Oct. 13, 2015

(54) D-RING FOR SLING

(71) Applicants: Thomas Ward, Thornton, CO (US); Michael T. Mayberry, Denver, CO (US); Richard M. Fitzpatrick, Longmont, CO (US)

(72) Inventors: Thomas Ward, Thornton, CO (US); Michael T. Mayberry, Denver, CO (US); Richard M. Fitzpatrick, Longmont, CO (US)

(73) Assignee: Magpul Industries Corp, Louisville, CO (US)

( * ) Notice: Subject to any disclaimer, the term of this patent is extended or adjusted under 35 U.S.C. 154(b) by 0 days.

(21) Appl. No.: 14/155,967

(22) Filed: Jan. 15, 2014

(65) Prior Publication Data

US 2014/0215767 A1 Aug. 7, 2014

Related U.S. Application Data

(60) Provisional application No. 61/752,907, filed on Jan. 15, 2013.

(51) Int. Cl.
*F41C 33/00* (2006.01)

(52) U.S. Cl.
CPC ..... *F41C 33/002* (2013.01); *Y10T 24/4764* (2015.01)

(58) Field of Classification Search
CPC ..... F41C 23/02; F41C 33/002; B66C 1/66; B66C 1/18; B66C 1/34; F16G 15/08; F16G 11/12; A01K 27/005; A44B 11/006; A44B 11/2549; A44B 11/263; B60P 7/0807; B60P 7/0823; F16B 19/1081; F16B 21/165; Y10T 24/4764; Y10S 224/913
USPC ..... 24/343, 265 AL, 457
See application file for complete search history.

(56) References Cited

U.S. PATENT DOCUMENTS

| | | | | | |
|---|---|---|---|---|---|
| 5,074,069 | A * | 12/1991 | Shire | 42/85 |
| 5,248,176 | A * | 9/1993 | Fredriksson | 294/215 |
| 5,284,129 | A * | 2/1994 | Agbodoe et al. | 600/230 |
| 5,660,423 | A * | 8/1997 | Herman et al. | 294/74 |
| 5,906,450 | A * | 5/1999 | Ng | 403/46 |
| 5,927,780 | A * | 7/1999 | Chandler | 294/82.11 |
| 6,032,993 | A * | 3/2000 | Kwon | 294/215 |
| 6,178,600 | B1 * | 1/2001 | French | 24/2.5 |
| 6,354,034 | B1 * | 3/2002 | Norris, Sr. | 42/85 |
| 6,393,677 | B1 * | 5/2002 | Anscher | 24/630 |
| D492,576 | S * | 7/2004 | Fiorentino et al. | D8/354 |
| 6,953,212 | B2 * | 10/2005 | Alba | 294/217 |
| D542,505 | S * | 5/2007 | Alba | D34/35 |
| 7,232,411 | B2 * | 6/2007 | Dinkler et al. | 600/233 |
| 7,654,027 | B1 * | 2/2010 | Grover | 42/85 |
| 7,654,028 | B1 * | 2/2010 | Grover | 42/85 |
| 7,708,511 | B2 * | 5/2010 | Terrill et al. | 411/400 |
| 8,857,680 | B1 * | 10/2014 | Thompson | 224/150 |
| 2003/0046853 | A1 * | 3/2003 | Norris | 42/85 |
| 2006/0254113 | A1 * | 11/2006 | Esch | 42/85 |
| 2010/0031897 | A1 * | 2/2010 | Moeller | 119/792 |
| 2010/0199541 | A1 * | 8/2010 | Vest et al. | 42/85 |
| 2011/0316297 | A1 * | 12/2011 | Franke | 294/215 |
| 2012/0227224 | A1 * | 9/2012 | Coleman et al. | 24/68 CD |

* cited by examiner

*Primary Examiner* — Victor Batson
*Assistant Examiner* — David Upchurch
(74) *Attorney, Agent, or Firm* — Geoffrey E. Dobbin; Dobbin IP Law P.C.

(57) ABSTRACT

Disclosed is a D-ring for use in sling systems, in particular firearm slings, where quick detachment and consistent behavior of the sling are of particular importance. At least two swivel sockets are provided on opposite sides of the D-ring for ambidextrous use and slots are provided to restrict rotational movement of the attached swivels. The D-ring may be formed from a single toroid or a conglomeration of different toroidal forms.

5 Claims, 5 Drawing Sheets

D-RING FOR SLING

CROSS-REFERENCES TO RELATED APPLICATIONS

The present Application claims priority as a non-provisional perfection of prior U.S. Provisional Application No. 61/752,907, filed Jan. 15, 2013, and incorporates the same by reference herein in its entirety.

FIELD OF THE INVENTION

The present invention relates to the field of slings and articles for carrying other items and more particularly relates to a D-ring for a firearm sling.

BACKGROUND OF THE INVENTION

Slings are well known in the art, having been made since time immemorial to help individuals and animals carry various loads. Almost any type of load may be made easier with an appropriate sling. Firearms are no exception. Slings have long been devised as an aid to carry a long firearm. An appropriate sling for a firearm will not only securely fasten the firearm to the user, but will also readily release in a manner for use. One feature of some modern firearm sling designs is a D-ring. The D-ring presents a flat side onto which a strap of a sling may be affixed. It also presents a rounded side onto which one or more straps may thereon be connected. Often, these straps tend to be somewhat mobile on the rounded portion of the D-ring, that is to say they move relative to the D-ring while the strap on the flat side tends to stay in place due to the severe bend in the "D" shape. One particular need is that one or more of the straps on the rounded side may need detached.

The present invention is a D-ring for a firearm sling featuring dual sockets for ambidextrous connection and an anti-rotation feature. The use of a socket also prevents traveling of straps on the rounded side of a D-ring. This structure of the present invention allows for quick adaptation of the sling system as need arises and also provides for a regulated consistency in the behavior of the sling, which aids in training and developing familiarity with a system.

The present invention represents a departure from the prior art in that the D-ring of the present invention features at least two quick-detach sockets on opposite sides of the D-ring so as to facilitate ambidextrous use. It also features specially bored slots in those sockets for bearing locked sling fittings so as to inhibit rotation of the fitting within the socket.

SUMMARY OF THE INVENTION

In view of the foregoing disadvantages inherent in the known types of sling hardware, this invention provides an improved D-ring with multiple attachment sockets and anti-rotation features. As such, the present invention's general purpose is to provide a new and improved D-ring that is easily incorporated into existing and future sling systems and also easily and instinctually used.

To accomplish these objectives, the preferred D-ring comprises a basic "D" shaped semi-toroidal body. The D-ring is essentially a torus formed by a shape (such as a circle or hexagon) being rotated about a central axis, having a major diameter "D" (FIG. 5) defined by the overall width of the D-ring and a minor diameter "d" (FIG. 6) defined by the shape rotated about the axis. A ring plane, shown along line A-A in FIG. 10, is also defined. One side of the D-ring is flat, with no curvature, and there is a transition from this flat side to the rounded portion of the D-ring. Thus, the shape is not a perfect torus. At least two sockets project outward from opposite sides of the D-ring. The sockets have four slots bored into them, two perpendicular to the ring plane, that capture ball bearings of most sling swivels. Of course, this is the preferred shape and arrangement of the D-ring—other possible shapes and arrangements shall be described herein.

The more important features of the preferred invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting. As such, the term D-ring is used for its common understanding in the art, which is to say a ring for connecting sling hardware that is usually shaped reminiscent of a letter "D." It is not to say that the D-ring must be shaped like a "D."

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the D-ring is herein described. It should be noted that the articles "a", "an", and "the", as used in this specification, include plural referents unless the content clearly dictates otherwise.

Figure 10:
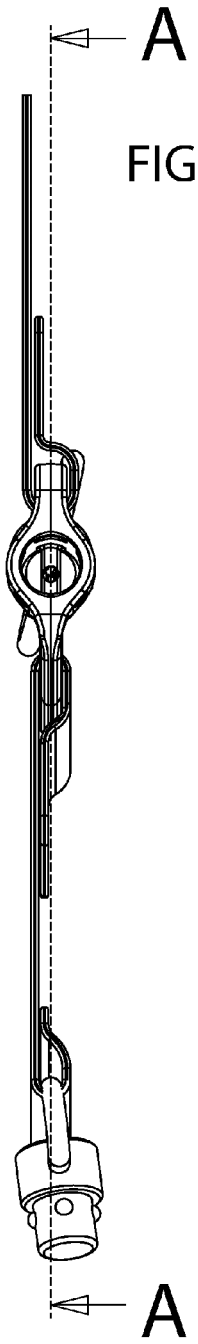
FIG. 10 is a side elevation of the sling apparatus of FIG. 8.
Figure 11:
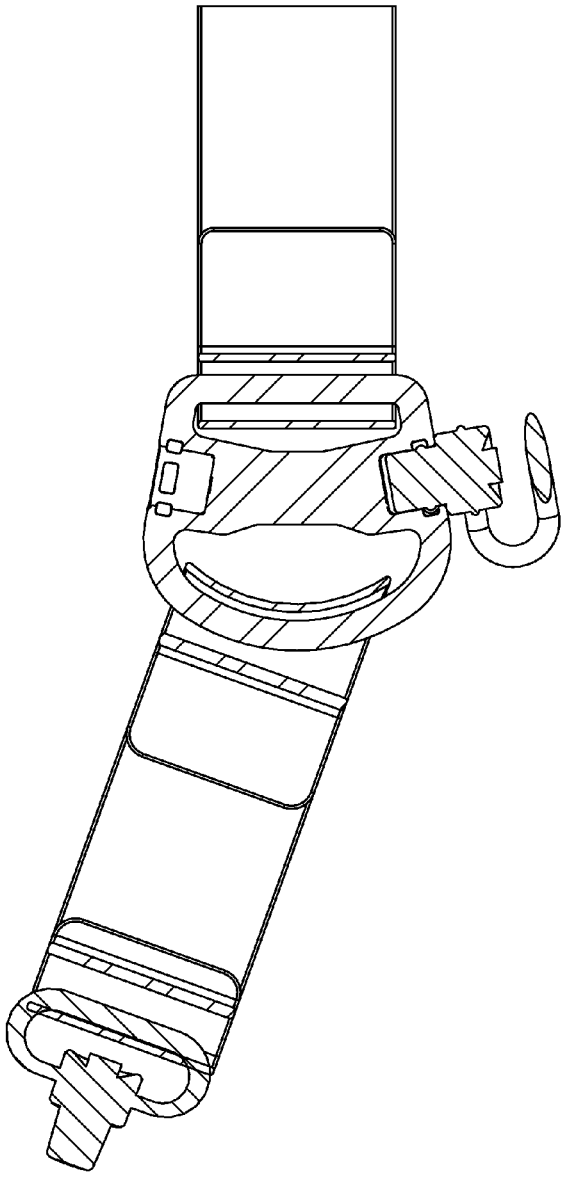
FIG. 11 is a sectional view of the sling apparatus of FIG. 10, taken along line A-A.

With reference to FIGS. 1-7, the D-ring is essentially a toroid, which is to say it is a two-dimensional base shape rotated about a central axis. The two-dimensional shape may be any desirable shape including but not limited to an ellipse or polygon. The preferred D-ring 10 is actually two semi-toroids and features a flat side 12 and a rounded side 16. A divider 14 generally bisects the D-ring 10 into two sections, bridging two transitional areas of the D-ring 10. The semi-toroids may be of different base shapes and may have two different central axes which may or may not be parallel to each other (thus forming two or more ring planes). For purposes of this application and the appended claims, single toroids and such conglomerations of two or more partial toroids shall be called "toroidal bodies" and the minor diameter or "thickness" of any toridal body at any given point will defined by the base shape of the toridal body at that given point. Two sockets 18 are located at the two ends of the divider 14. The sockets 18 are generally round, according to the shape of most modern swivels, but any shape may be used so long as it fits a swivel. They also tend to be thicker than the body of the D-ring 10. In addition, it should be noted that while two sockets are provided for ambidextrous fitting of the sling swivel, additional sockets may yet be provided. The divider 14 buttresses the two sockets and provides additional reinforcement to them. Along the periphery of the sockets are a number of slots 20, 22. These slots are provided to interface with ball bearings utilized in modern push-button quick detach sling swivels. The two interior slots 22 are, in actuality, bores parallel to a minor diameter "d" which is in turn orthogonal with the ring plane. Each of these bores presents an oblong slot where the bore and socket interface (FIGS. 10, 11). It should be noted that the position of the slots 20, 22 shown are exemplary and that they may be positioned along any portion of the periphery of the sockets 18. Thus, there may be more or less than 4 slots which may be bores, slots or partial bores and they may or may not be orthogonal to the ring plane.

Figure 1:
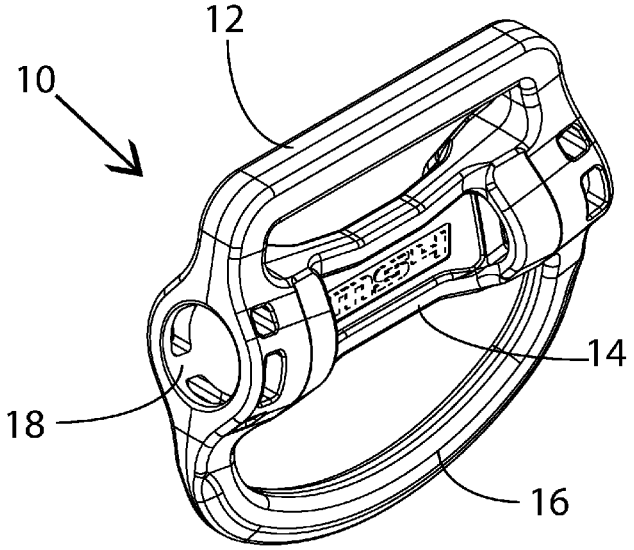
FIG. 1 is a perspective view of one embodiment of a D-ring according to the present invention.
Figure 2:
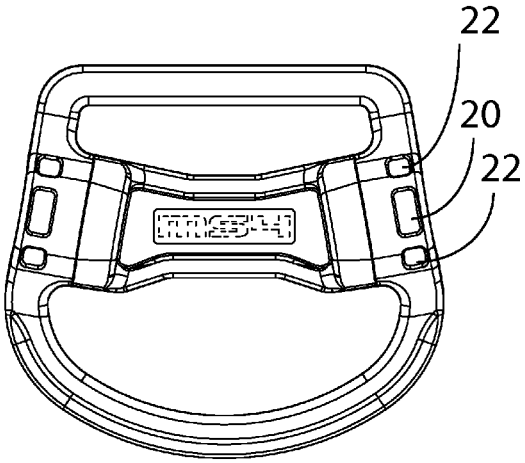
FIG. 2 is a front elevation of the D-ring of FIG. 1.
Figure 3:
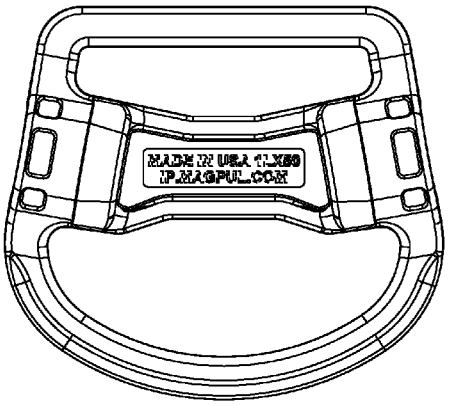
FIG. 3 is a rear elevation of the D-ring of FIG. 1.
Figure 4:
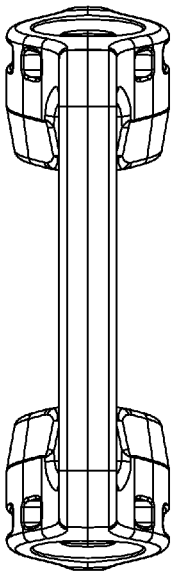
FIG. 4 is a top plan view of the D-ring of FIG. 1
Figure 5:
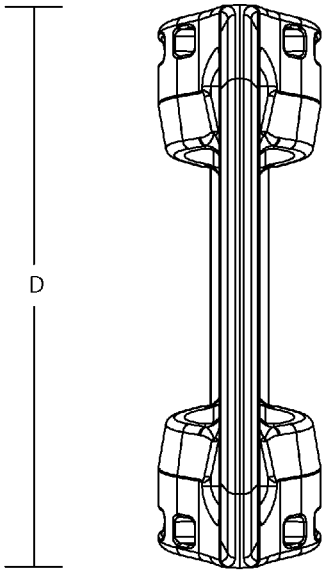
FIG. 5 is a bottom plan view of the D-ring of FIG. 1.
Figure 6:
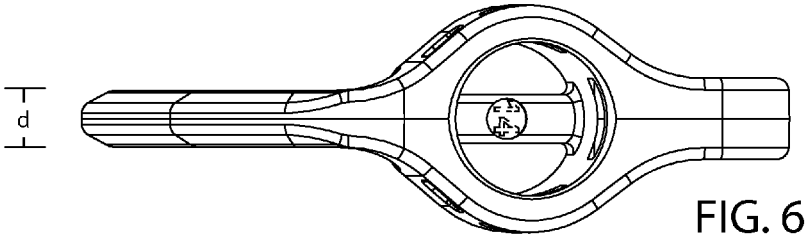
FIG. 6 is a right elevation of the D-ring of FIG. 1.
Figure 7:
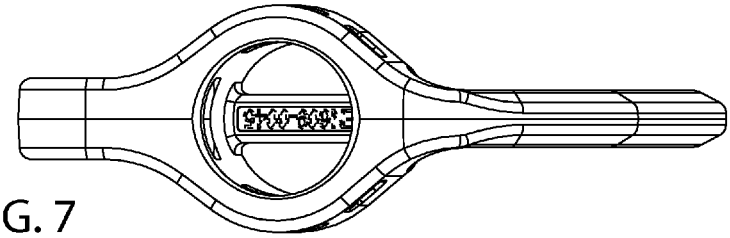
FIG. 7 is a left elevation of the D-ring of FIG. 1.
Figure 8:
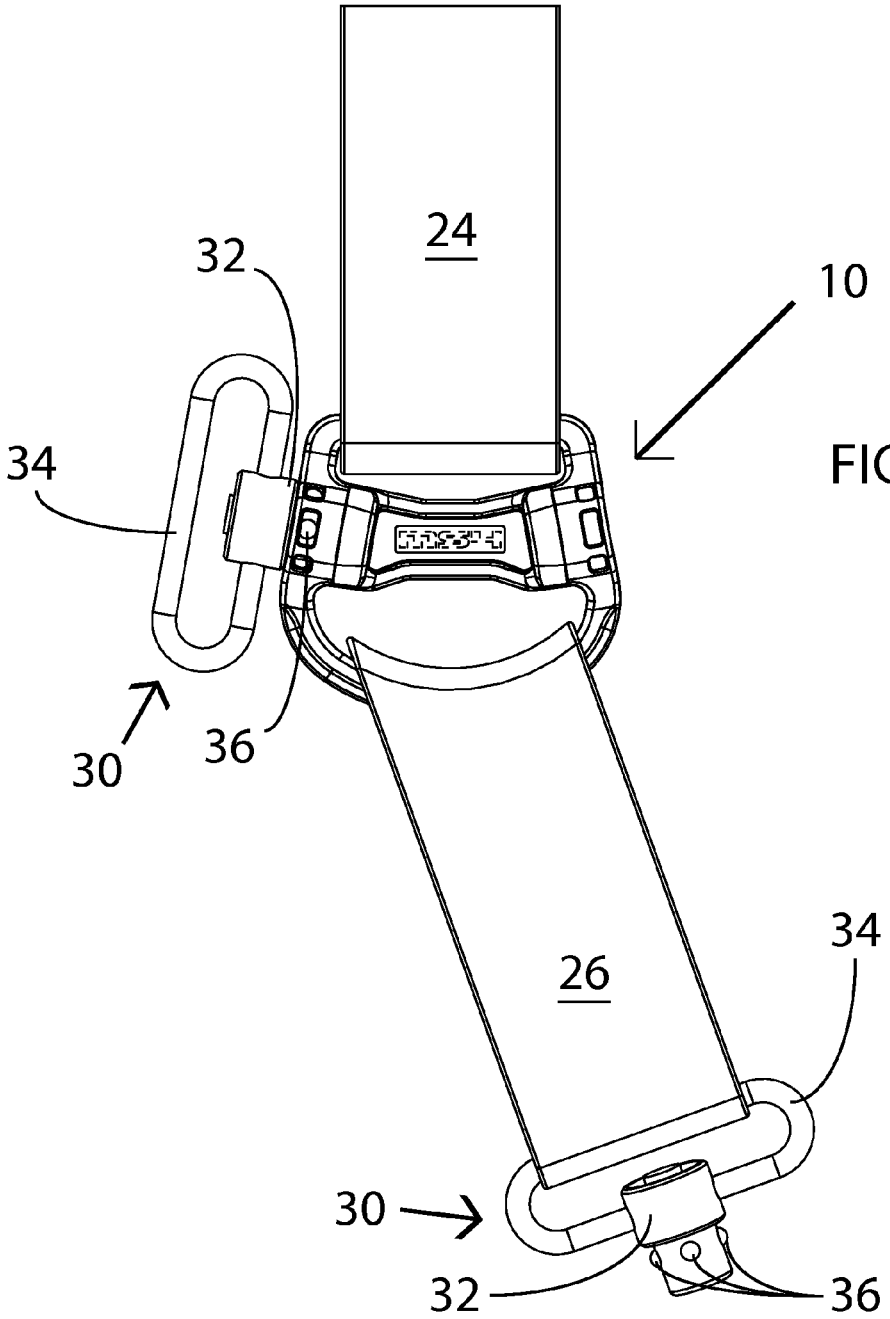
FIG. 8 is a front elevation of the D-ring of FIG. 1 utilized in a sling apparatus.
Figure 9:
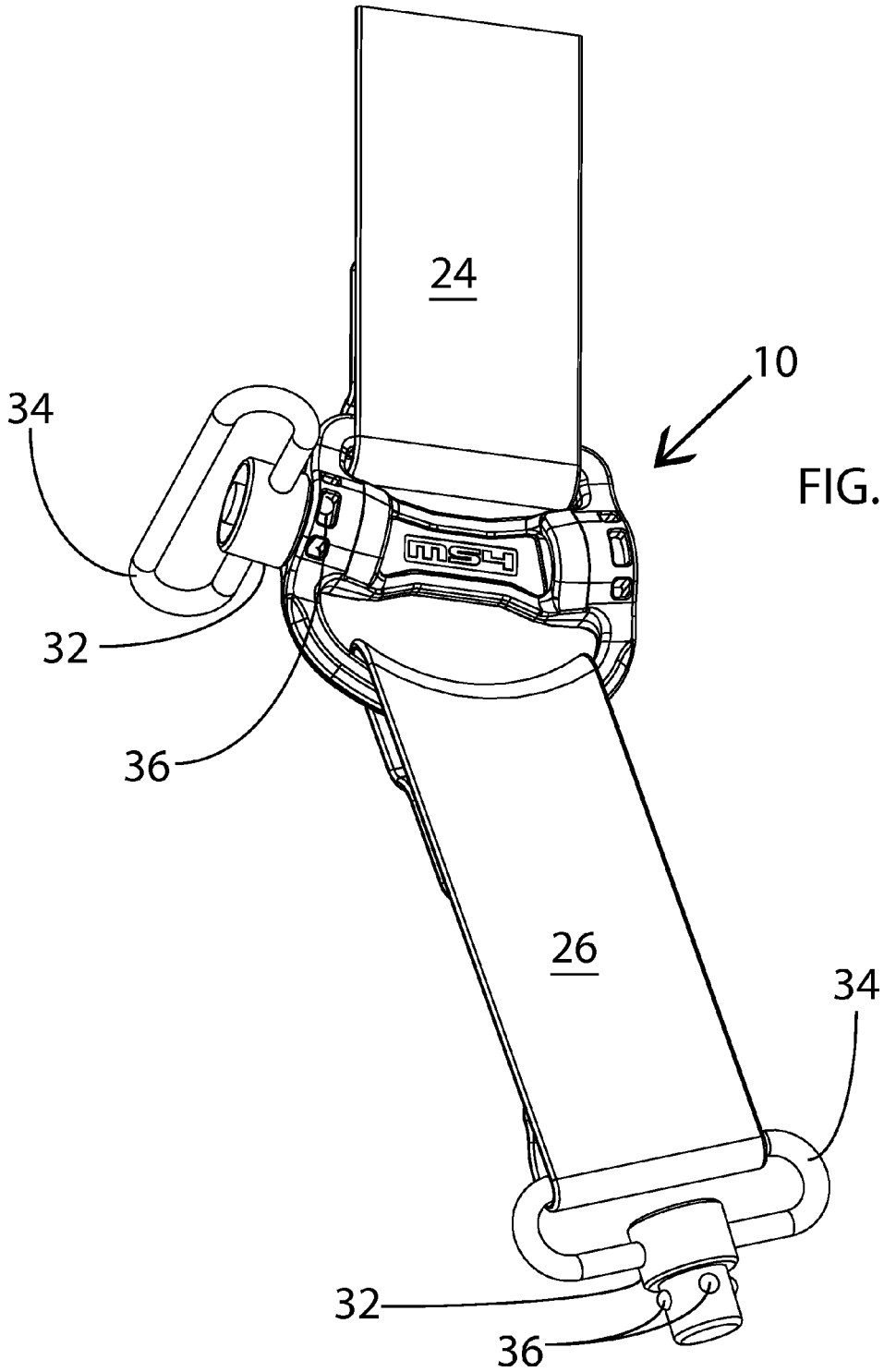
FIG. 9 is a perspective view of the D-ring of FIG. 1, wherein side swivel has been repositioned from FIG. 8.

In use, shown in FIG. 8, the D-ring 10 is sewn into one or more straps 24, 26 of a sling. Swivels 30 are also provided in the sling system. Basically, the swivel 30 has a plug body 32 out of which a loop, or bail, 34 projects. At the base of the plug body 32, is a plurality (usually 4) of spring biased ball bearings 36. Various methods of spring biasing these ball bearings are known and used within the art. The swivel 30 is then inserted into either of the sockets 18 and the ball bearings 36 then interface with slots 20, 22, locking the swivel into place. The location and size of the slots 20, 22 also inhibit rotation of the swivel about its axis, requiring the swivel to be removed and re-inserted (FIG. 9) should a larger degree of rotation is needed.

A number of variations may be made to the described preferred embodiment and still fall within the purview of the invention. First, the number of the sockets 18 may be increased and placed at any advantageous location on the D-ring. The preferred embodiment of this invention is that at least two sockets will be present on opposite sides of the D-ring so as to accomplish the object of ambidexterity. Having two sockets on the same side, while not preferred, is still within the purview of this invention. The sockets need not be diametrically opposite as is depicted in the figures and the further addition of 1, 2, or 3 more sockets will not prevent at least one pair of sockets from being on "opposite" sides. Differing socket number and position may require slightly different designs of the divider 14 in order to provide adequate support. The divider 14 can also be eliminated if desired, though it is not preferable. Second, the overall shape of the D-ring may also be altered so that it may be a perfect torus, a square, or any other shape a user may find to be advantageous. Likewise, while described as being a circle, even using the term "diameter" to describe its width, the base shape of the ring body may be any suitable shape to allow connection of slings or sling straps to the ring. In practice, the D-ring may be manufactured out of any suitable material including metals, polymers, or composites. Identifying and marketing indicia may be placed effectively on the divider 14. The D-ring may also be used for slings other than for firearms.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A sling with at least two strap ends and a D-ring, the D-ring comprising:

a) a rigid toroidal body having a circumference and a minor diameter defined by a width of a shape defining the toroidal body with at least one section of the circumference having a rounded curvature and one section having no curvature;

b) a plurality of swivel sockets spaced apart along the circumference of the ring body; and c) a divider crossing the toroidal body of the D-ring and serving as an anchor for at least two sockets and separating the section with the rounded curvature and the section with no curvature from each other;

wherein one strap end of the sling is threaded around the section of the circumference with the rounded curvature and another strap end is threaded around the section of the circumference with no curvature.

2. The sling of claim 1, further comprising a plurality of slots around a periphery of each socket.

3. The sling of claim 2, at least two of the slots around each socket being bores drilled along a periphery of each socket.

4. The sling of claim 1, the toroidal body being formed by a plurality of partial tori.

5. The sling of claim 4 each partial tori having a distinct base shape.

* * * * *